United States Patent [19]

Slusser

[11] Patent Number: 4,896,593

[45] Date of Patent: Jan. 30, 1990

[54] VERTICAL TRASH COMPACTOR

[75] Inventor: Boyd C. Slusser, Jenison, Mich.

[73] Assignee: Sebright Products, Incorporated, Hopkins, Mich.

[21] Appl. No.: 174,002

[22] Filed: Mar. 28, 1988

[51] Int. Cl.[4] ..... B30B 15/06; B30B 15/16

[52] U.S. Cl. ..... 100/53; 100/100; 100/215; 100/229 A; 100/233; 100/237; 100/241

[58] Field of Search ..... 100/53, 112, 193, 229 A, 100/233, 236, 237, 241, 246, 258 A, 295, 205, 215, 48, 208, 209, 100

[56] References Cited

U.S. PATENT DOCUMENTS

| | | | |
|---|---|---|---|
| 2,700,333 | 1/1955 | Polsen et al. | 100/229 |
| 3,130,761 | 4/1964 | Fleming et al. | 100/53 X |
| 3,513,768 | 5/1970 | Altmann et al. | 100/233 X |
| 3,691,944 | 9/1972 | Boyd | 100/229 A |
| 3,717,091 | 2/1973 | Moon | 100/53 |
| 3,868,903 | 3/1975 | Montalbano | 100/45 |
| 3,881,407 | 5/1975 | Goar | 100/35 |
| 3,893,386 | 7/1975 | Wise | 100/209 X |
| 3,901,139 | 8/1975 | Moriconi | 100/229 A X |
| 4,005,648 | 2/1977 | Edwards | 100/53 |
| 4,147,100 | 4/1979 | Dykstra | 100/48 |
| 4,183,295 | 1/1980 | Peterson | 100/53 |
| 4,235,165 | 11/1980 | Fenner et al. | 100/53 |
| 4,271,756 | 6/1981 | Bettencourt | 100/229 A X |
| 4,290,352 | 9/1981 | Schmidt et al. | 100/233 X |
| 4,424,740 | 1/1984 | Gwathney et al. | 100/52 |

FOREIGN PATENT DOCUMENTS

| | | |
|---|---|---|
| 2425584 | 12/1974 | Fed. Rep. of Germany . |
| 564467 | 7/1975 | Switzerland . |
| 596980 | 3/1978 | Switzerland . |

OTHER PUBLICATIONS

Advertising Brochure, undated, for Auto Shred Compactor distributed by Kay Enterprises, Highway 218 South, Janesville, Iowa 50647.

*Primary Examiner*—Philip R. Coe
*Assistant Examiner*—Stephen F. Gerrity
*Attorney, Agent, or Firm*—Varnum, Riddering, Schmidt & Howlett

[57] ABSTRACT

A vertical trash compactor (10) comprises a dual ram assembly (18) for compacting trash which has been placed into an open top container (16) through a loading door (28). A primary ram unit (20) is pivotally mounted to a housing (12) for movement between a retracted loading position above the container (16) and a normal position adjacent to the top of the container (16). A secondary ram (22) unit is mounted to the primary ram unit (20) for pivotal rotation in a direction opposite the primary ram unit (20), between a retractive position relative to the primary ram unit (20) and an extended position within the container (16). A door lock (30) is also provided whereby the loading door (28) cannot be opened unless the primary ram unit (20) is in the retracted loading position.

18 Claims, 9 Drawing Sheets

VERTICAL TRASH COMPACTOR

BACKGROUND OF THE INVENTION

1. Field of the Invention

This invention relates to a compactor for waste material, and more particularly to a vertical waste compactor adapted to compress waste material into an open-top container which is selectively removable from a supporting base.

2. Description of the Prior Art

Vertical trash compactors are increasingly used in small businesses such as fast-food restaurants and the like. An example of such compactors is disclosed in U.S. Pat. No. 4,235,165 issued Nov. 25, 1980 to Fenner et al. A compactor has a ram unit pivotably supported on a frame. The ram unit can alternately move between a retracted and extended position. The compactor is mounted on a supporting frame which permits a container to be moved beneath the compactor, hence the expression "vertical trash compactor." When trash is placed into the container, the ram extends into the container to compress the trash.

Some vertical compactors contain elaborate interlock mechanisms to provide a margin of safety for users. For example, U.S. Pat. No. 4,424,740 issued Jan. 10, 1984 to Gwathney et al discloses a vertical trash compactor with a single ram which moves between retracted and extended positions and is mounted on a frame adapted to receive an open-top container. An interlock means is provided whereby the compactor will not operate unless the container is in proper position, and further whereby the compactor will not operate if the door if opened.

Single-ram compactors compress trash in one direction which tends to force the container outwardly from beneath the compactor. Thus, existing compactors require mechanical means to maintain the container in position beneath the compactor. Also, larger hydraulic units requiring more height are needed to obtain the necessary compressive strength within the container when a ram unit with a single pivot point is used. Further, existing interlock systems are complex, with many parts prone to failure. Existing compactors also do not provide for easy removal of the compactor portion from the base, thereby increasing the difficulty of moving the compactor to a specific site and limiting the flexibility of adapting its configuration to the site.

SUMMARY OF THE INVENTION

The invention relates to a compactor for waste material of the type having a housing mounted on a base with an open top container adapted to be received within the base. The container is further adapted to receive waste material to be compacted. According to the invention, a dual ram assembly is provided for compacting trash in the container. A primary ram unit is pivotally mounted at one end thereof to the housing with the other end being free for movement between a retracted loading position in spaced relation above the container and a normal position adjacent to the top of the container. A secondary ram unit is carried by the primary ram unit and is pivotally mounted to the primary ram unit near its free end. The free end of the secondary ram unit is selectively movable between an extended position within the container when the primary ram unit is in the normal position and a retractive position relative to the primary ram unit adjacent to the pivotal end of the primary ram unit. A power system is connected to the primary and secondary ram units and serves to move them between their respective positions. A controller means connected to the power system controls the sequence of movement of the primary and secondary ram units.

Preferably, the base has sides comprised of separate legs connected by cross members and to which are secured parallel container guides adapted to receive the container in sliding engagement. The housing is removably mounted to the base in a manner whereby the housing can be rotated 90° and reattached to the base to provide easier transport of the compactor and flexibility in adapting it to a specific site.

The housing is typically enclosed by top, side, front, and rear panels. A hinged door is mounted to one of the side panels and is adapted to close an opening for receiving waste material defined by the front panel. The door latches to the other side panel by a movable rod mounted to the door and received in an elongated slot in the side panel. There is also provided a pair of wiper blades, each of which cleans a front plate on one of the ram units.

The invention also provides a door lock whereby the door cannot be opened unless the primary ram unit is in the retracted loading position. The lock comprises a lock plate rigidly secured to a hinged end of the door and extending beyond to a position adjacent to and parallel with a side wall of the primary ram unit when the primary ram unit is away from the retracted loading position. When the primary ram unit is in the retracted loading position, the lock plate is free of the side wall and the door can be opened.

There is thus provided a vertical compactor with dual rams, each of which pivots in a direction opposite the other. This two-directional compression tends to maintain the container in position beneath the housing. The dual rams also permit more compressive strength to be applied to the waste material without sacrificing height in the compactor. The mechanical door lock simply and reliably prevents the door from opening when the compactor is operating or the rams are in any but the loading position. Further, the compactor of the present invention is more easily transportable than existing compactors and can be more readily configured to adapt to a specific site.

BRIEF DESCRIPTION OF THE DRAWINGS

The invention will now be described with reference to the accompanying drawings in which.

DETAILED DESCRIPTION OF THE PREFERRED EMBODIMENT

Figure 2:
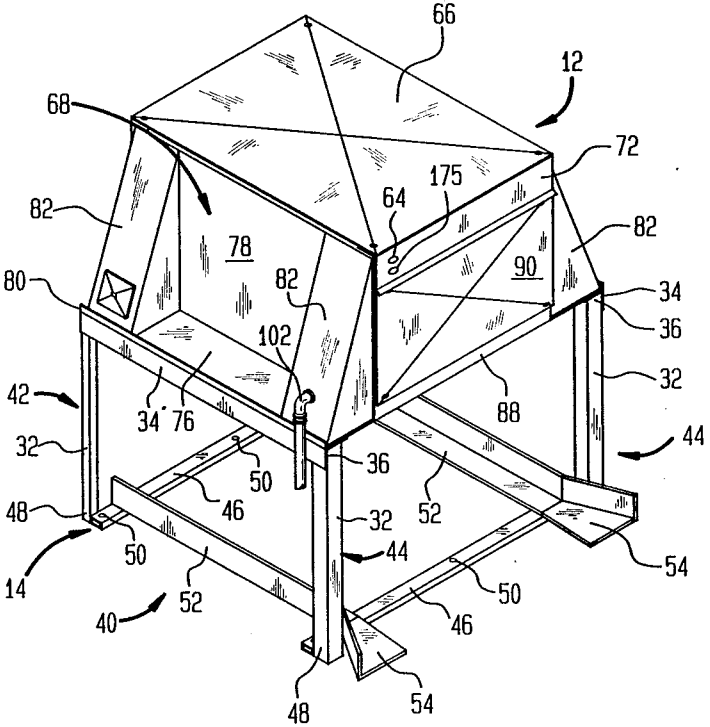
FIG. 2 is an isometric view of the vertical trash compactor of FIG. 1 showing the rear and right sides.
Figure 1:
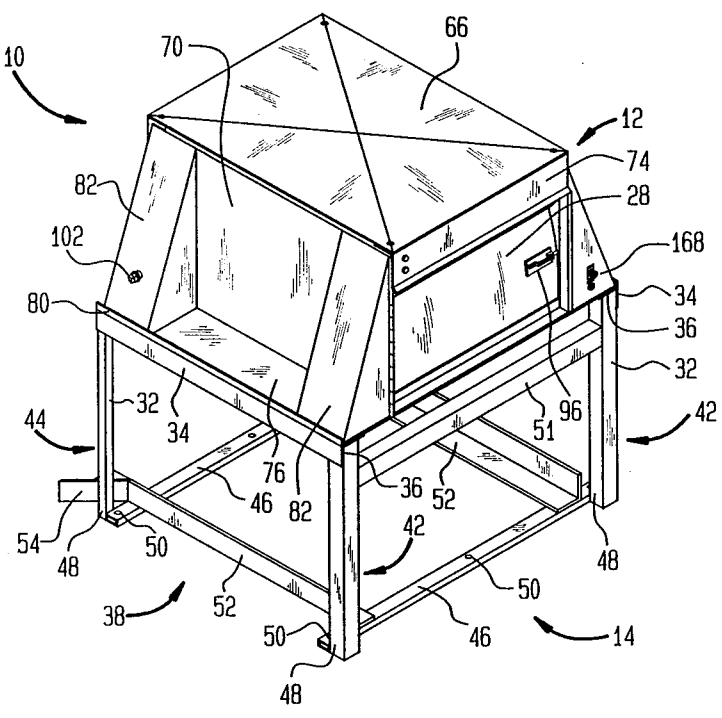
FIG. 1 is an isometric view of a vertical trash compactor according to the invention showing the front and left sides.
Figure 4:
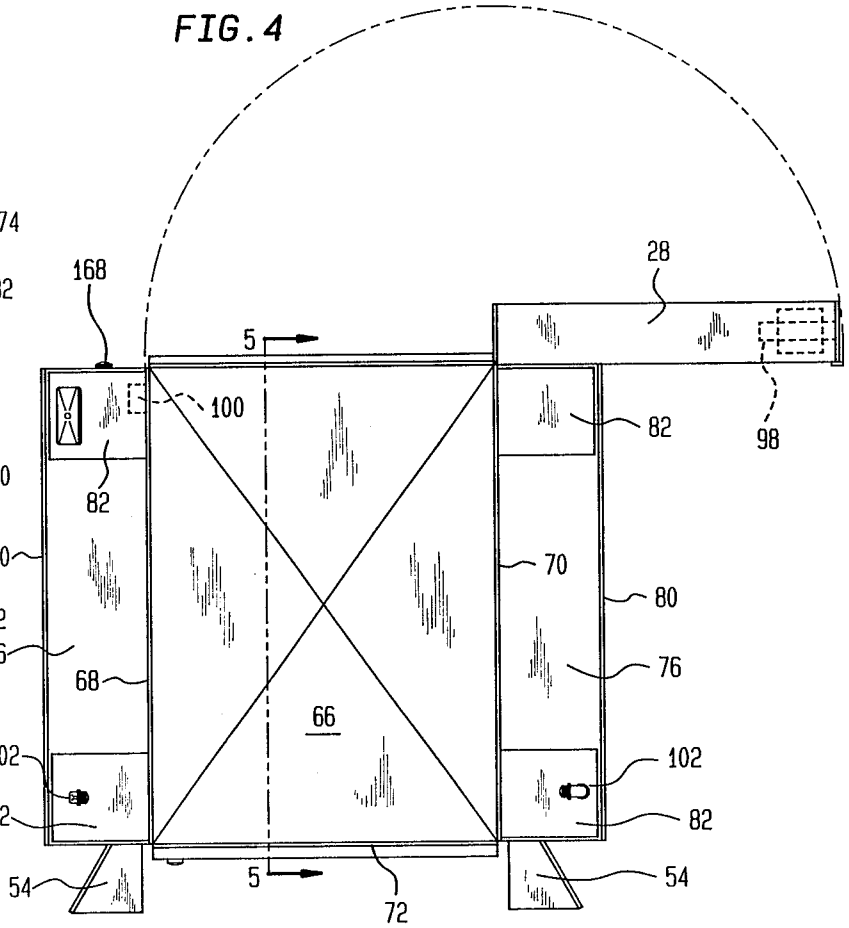
FIG. 4 is a plan view, showing the loading door opened.

Referring now to the drawings and to FIGS. 1 and 2 in particular, there is shown a vertical trash compactor 10 generally comprising a housing 12 mounted on a base 14. The base 14 is adapted to receive an open top container 16 (as in FIG. 3) in a manner such that the container 16 will be situated directly beneath the housing 12. As shown also in FIGS. 7–11, the housing 12 encloses a ram assembly 18, which is pivotally mounted to the housing 12, and adapted for movement to a retracted, loading position in spaced relation above the container 16, from a normal position adjacent to the top of the container, and also to an extended compacting position within the container. The ram assembly 18 comprises two independently operable ram units, a primary ram unit 20 and a secondary ram unit 22 as shown further in FIG. 5. The secondary ram unit 22 is carried by and pivotally mounted to the primary ram unit 20. The movement of the primary ram unit 20 defines the retracted loading position of the ram assembly 18 and the normal position of the ram unit 20 adjacent to the top of the container 16. The movement of the secondary ram unit 22 defines the extended compacting position of the ram assembly 18 within the container 16. The housing 12 also encloses a power system 24 which powers the ram assembly 18, and a controller system 26 which controls the sequence of movement of the ram assembly 18. A loading door 28 on the housing 12 provides access to the interior of the container 16. An interlock means 30 (FIG. 5 and 6) prevents the loading door 28 from being opened when the ram assembly 18 is in any but the retracted, loading position.

As shown in FIGS. 8–11, waste material is received within the container 16 when the ram assembly 18 is in the retracted loading position and the door 28 is open. When the door 28 is closed, the compactor 10 can be operated whereby the ram assembly 18 will compress the waste material first in one direction by the primary ram unit 20, then in an opposite direction by the secondary ram unit 22.

Referring now to FIGS. 1–4, the base 14 comprises four legs 32 preferably of tubular steel, each of them square in cross section. A lateral support member 34 is secured, as by welding, to and between respective upper ends 36 of a pair of legs 32. The pairs of legs 32 and the respective lateral support members 34 extending therebetween thus form a left side 38 and a right side 40, respectively of the base 14. Two of the legs thus comprise front legs 42 and the other two legs rear legs 44. A cross member 46, generally formed of tubular steel rectangular in cross section, is rigidly secured, as by welding, to and between the front legs 42 at a lower end 48 of each leg 32. A second cross member 46 is likewise secured to and between the rear legs 44 at a lower end 48 of each leg 32. The cross members 46 can be secured to any support surface by suitable means, such as, for example, bolts (not shown) through apertures 50. A bracing member 51 extends to and between the front legs 42 near to the upper ends 36 thereof. Container guides 52, generally L-shaped, are disposed opposite each other to and between the cross members 46, one being located near to the right side 40 and the other near to the left side 38. Each container guide 52 has a flare end 54 extending outwardly of the rear legs 44 to assist in guiding the container into the base 14. The base 14 is thus generally U-shaped with guides 52 at a lower portion thereof to receive an open top container 16 which receives waste material.

Figure 3:
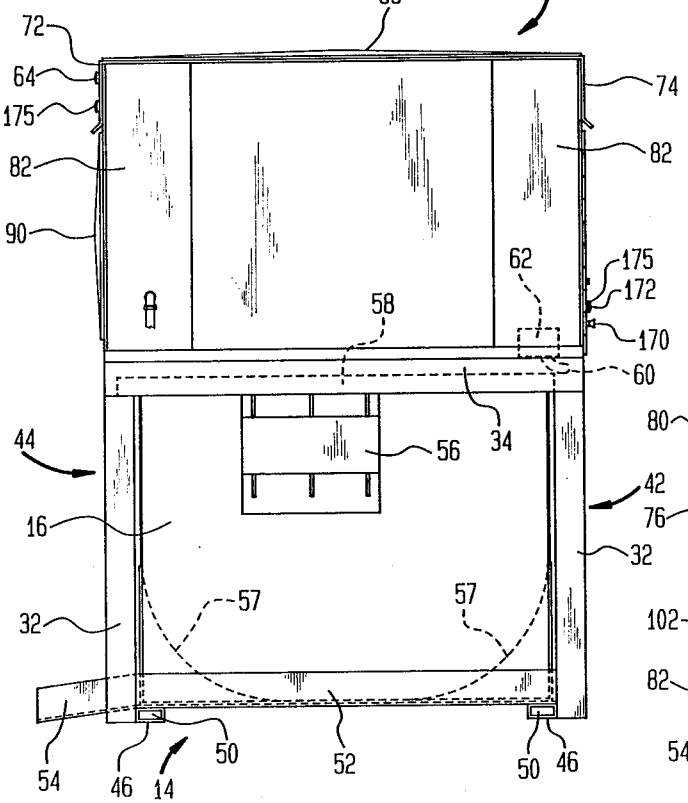
FIG. 3 is a left side elevational view of the vertical trash compactor of FIG. 1 showing also the container.

As seen in FIG. 3, the container 16 is adapted to be removably received within the base 14, between the flared ends 54, and onto the container guides 52. The container 16 has side brackets 56, by which a vehicle (not shown) can grip the container 16 and insert it or remove it from the base 14. The shape of the container is not critical as long as it is adapted to receive the secondary ram unit 22 and fit within the base 14 on the container guides 52. In the embodiment shown, the container 16 has rounded corners 57 therein which may assist in directing the flow of waste material in the container 16. An upper rim 58 on the container 14 engages a lever 60 depending from the housing 12 into the area provided between the front legs 42. The lever 60 is connected to a microswitch 62 within the housing 12. The microswitch 62 is, in turn, electrically wired to the controller system 26 and to an indicator light 64 on the housing 12. The switch 62 serves as an interlock mechanism such that, when the rim 58 of container 16 does not engage the depending lever 60 to trip the switch 62, an open electrical circuit will prevent the power system 24 from moving the ram assembly 18 and the compactor 10 will not operate.

The housing 12 is removably bolted to the support members 34 of the base 14. The legs 32 of the base 14 are preferably equally spaced apart. The housing 12 is likewise so dimensioned that the housing can be removed from the base 14, rotated in ninety-degree increments and reattached to the base 14. Thus the housing 12 can be maintained in any one of four orientations with respect to the base and the container guides in the base. It will be apparent that the configuration of compactor 10 can be easily conformed to site specific requirements where, for example, the container 16 must be removed from the base 14 at 90° with respect to the loading door 28.

The housing 12 comprises generally a top panel 66, a right side panel 68, a left side panel 70, a rear panel 72, and a front panel 74. Each side panel 68, 70 is formed of plate steel, with a bottom flange 76 extending roughly 90° laterally outwardly from a panel portion 78 thereof. An outer rim 80 extends upwardly from the bottom flange 76 of each side panel 68, 70. A pair of buttresses 82 are secured as by welding to each side panel 68, 70, one adjacent the front panel 74 and the other adjacent the real panel 72 thereof to strengthen the housing 12. A bottom frame member 88 extends between the right side panel 68 and the left side panel 70 to provide support for the power system 24 and controller system 26 (see FIG. 5). An access door 90 is removably mounted to the rear panel 72 and the rear buttresses 82 of each side panel 68, 70. An inwardly extending flange 92 depends from the front panel 74 and defines an angular opening 94 (FIGS. 4 and 8) for receiving waste material into the container 16 when the container is beneath the housing 12 and the ram assembly 18 is in the retracted loading position. The loading door 28 covers the opening 94. The loading door 28 is arcuate in shape and is hingedly mounted to the front buttress 82 of the left side panel 70. Referring again to FIG. 5, a door safety switch 97 is mounted on the flange 92 depending from the front panel 74. An actuator 99 in the form of a pin or cam, extends from the switch 97 and is positioned to be engaged by the door 28 when the door is closed. When the door 28 is opened, the actuator 99 is disengaged thus turning off the switch 97 and disabling the compactor 10. A latch mechanism 96 for the door 28 comprises a movable rod 98 and an elongated slot 100. The movable rod 98 is mounted on the door 28 near the free end thereof and is adapted to align with and be received in the elongated slot 100 on the interior of the right side panel to permit manually latching the door 28 when it is closed. The heavy weight of the door 28 tends to pull the free end thereof downwardly, so the slot 100 is elongated to enable it to receive the movable rod 98 without regard to vertical alignment. A power input lead 102 extends through one of the buttresses 82 on either side of the housing 12 to the interior thereof. The buttresses 82, in addition to strengthening the housing 12, permit the housing to rest across the top of the base 14 such that the ram assembly 18 can extend downwardly into the container 16 spaced between the sides 38, 40 of the base 14.

Figure 5:
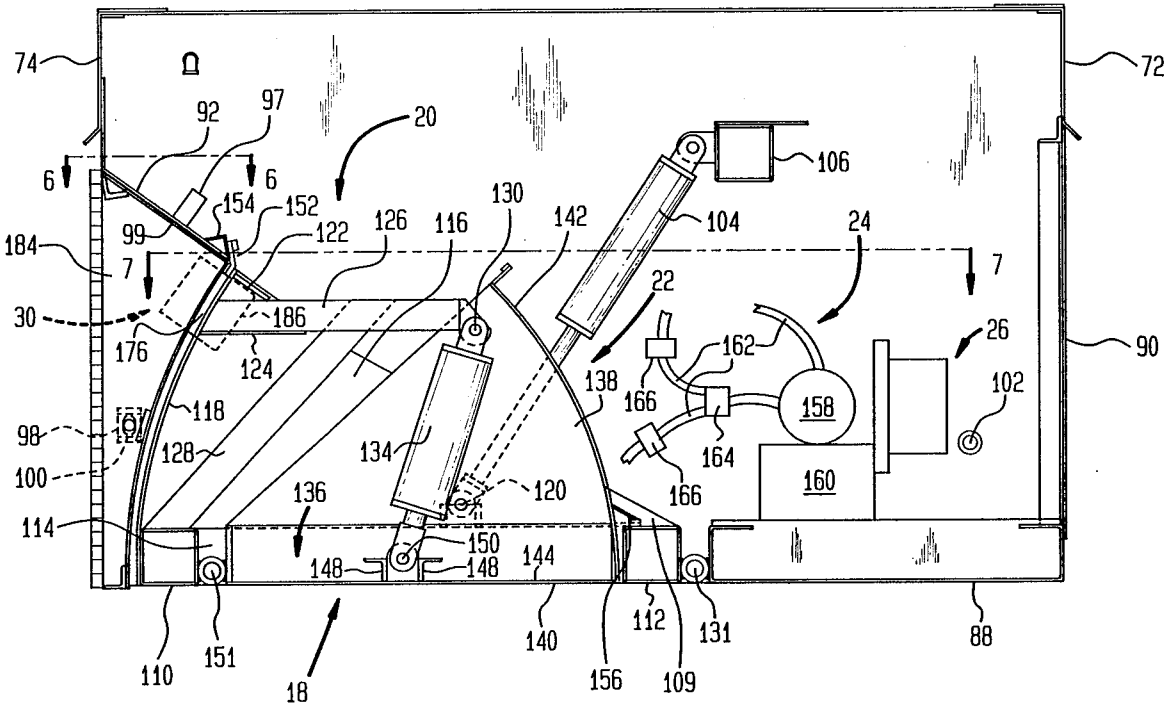
FIG. 5 is a sectional view taken of the housing generally along line 5—5 of FIG. 4.
Figure 7:
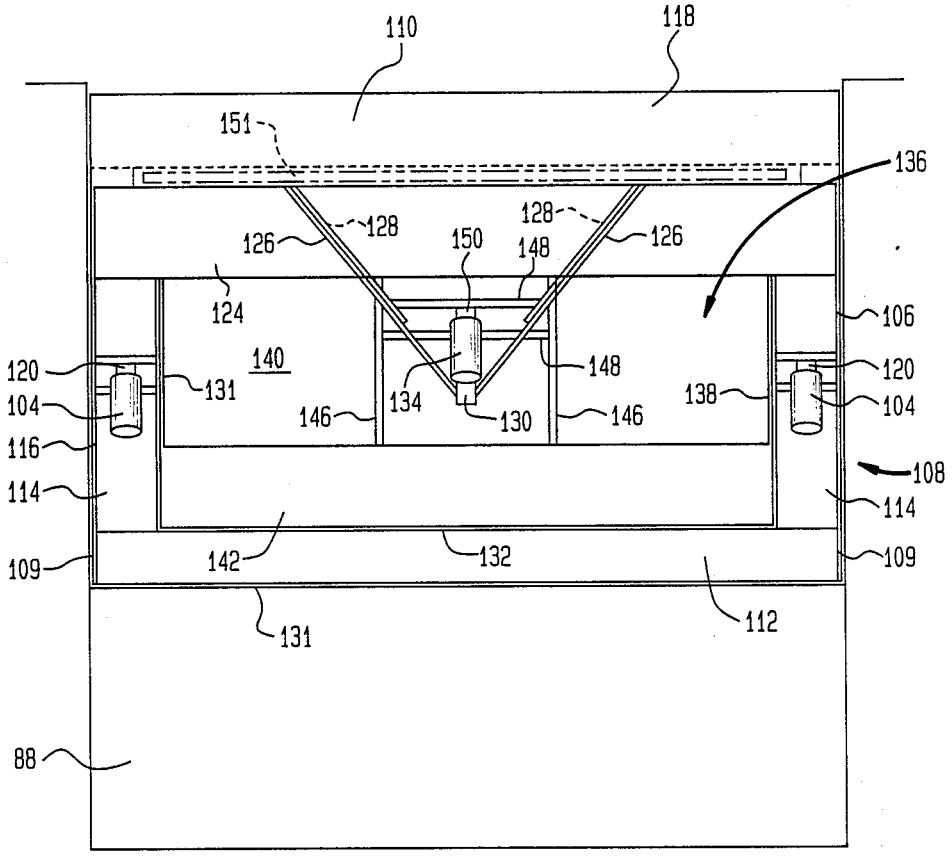
FIG. 7 is a fragmentary cross sectional view of the housing taken along line 7—7 of FIG. 5.

As can be seen in FIGS. 5 and 7, the primary ram unit 20 of the ram assembly 18 comprises two hydraulic cylinders 104, each of which is pivotally connected at one end to a cross member 106 rigidly secured to the housing 12, and at the other end to a primary platen 108. The primary platen 108 comprises a front member 110, a rear member 112, and two oppositely disposed side members 114. Extending upwardly from each side member 114 is a cuneate shaped side plate 116. Each side plate 116 is positioned such that the vertex 109 thereof is secured to the rear member 112. An arcuate front plate 118 extends upwardly from the front member 110, and is rigidly secured to each side plate 116. A clevis 120 extending upwardly from each side member 114 provides a pivotal connection for the end of each primary hydraulic cylinder 104. A transverse strengthening bar 122 extends laterally across the top of the front plate 118, and is rigidly secured to each side plate 116. A support plate 124 extends inwardly of the front plate 118 to provide additional strengthening to the primary ram unit 20, and also to support two clevis supports 126 extending rearwardly inwardly from the front plate 118. A pair of clevis braces 128 are rigidly secured between the front member 110 and the clevis supports 126. A secondary ram cylinder clevis 130 is rigidly secured to the ends of the clevis supports 126 and spaced equidistant from the opposing side plates 116. The arcuate shape of the front plate 118 is complementary to the arcuate shape of the loading door 28. The primary platen 108 is mounted to a pivot at the bottom frame member 88 of the housing 12. The members 110, 112, 114 of the primary platen 108 define an opening 132 for the secondary ram unit 22.

The secondary ram unit 22 comprises a secondary hydraulic cylinder 134, pivotally mounted at one end to the secondary ram cylinder clevis 130, and at the other end to a secondary platen 136. As in the primary platen 108 described above, the secondary platen 136 comprises a pair of cuneate side plates 138 extending upwardly from a face plate 140 and oppositely disposed to each other, and an arcuate front plate 142 extending upwardly from the face plate 140, rigidly secured to the side plates 138. An upper surface 144 of the secondary platen 136 is reinforced with internal braces 146 running the length of the platen 136, and a pair of lateral braces 148 extending therebetween. A platen clevis 150 is rigidly secured between lateral extending braces 148 to provide the pivotal secondary platen connection with the secondary hydraulic cylinder 134. The secondary platen 136 is mounted to a pivot 151 at front member 110 of the primary platen 108 in the opening 132 defined by the primary platen 108. Thus, the secondary ram unit 22 pivots with respect to the primary ram unit 20, while the primary ram unit 20 pivots with respect to the housing 12, both rotational movements being in opposite directions. Thus, compression force on the waste material in the container 16 tends to be in opposite directions as the respective ram units are pivotted, which in turn tends to maintain the container 16 stationary.

A primary ram wiper blade 152 is mounted on a cross member 154 at a lower end of the flange 92 depending from the front panel 74 of the housing 12. The blade 152 wipes the front plate 118 of the primary ram unit 20 as the ram pivots outwardly between the retracted loading position and the normal position. A secondary ram wiper blade 156 is mounted to the rear frame member 112 of he primary platen 108 to wipe the front plate 142 of the secondary ram unit 22 as the secondary ram unit pivots within the primary ram unit 20.

The ram assembly 18 is driven by the power system 24 which is preferably a hydraulic type. The power system 24 comprises an hydraulic pump 158 driven by an electric motor 160, both of which are preferably mounted within the housing 12. Fluid conduits 162 carry pressurized hydraulic fluid to the primary hydraulic cylinders 104 and to the secondary hydraulic cylinder 134. A pressure switch 164 is provided on the pressure side of the hydraulic pump 158 to sense line pressure and send appropriate signals to the controller system 26. Directional valves 166 in the fluid conduits 162 direct flow of the fluid in response to signals from the controller system 26.

Figure 12:
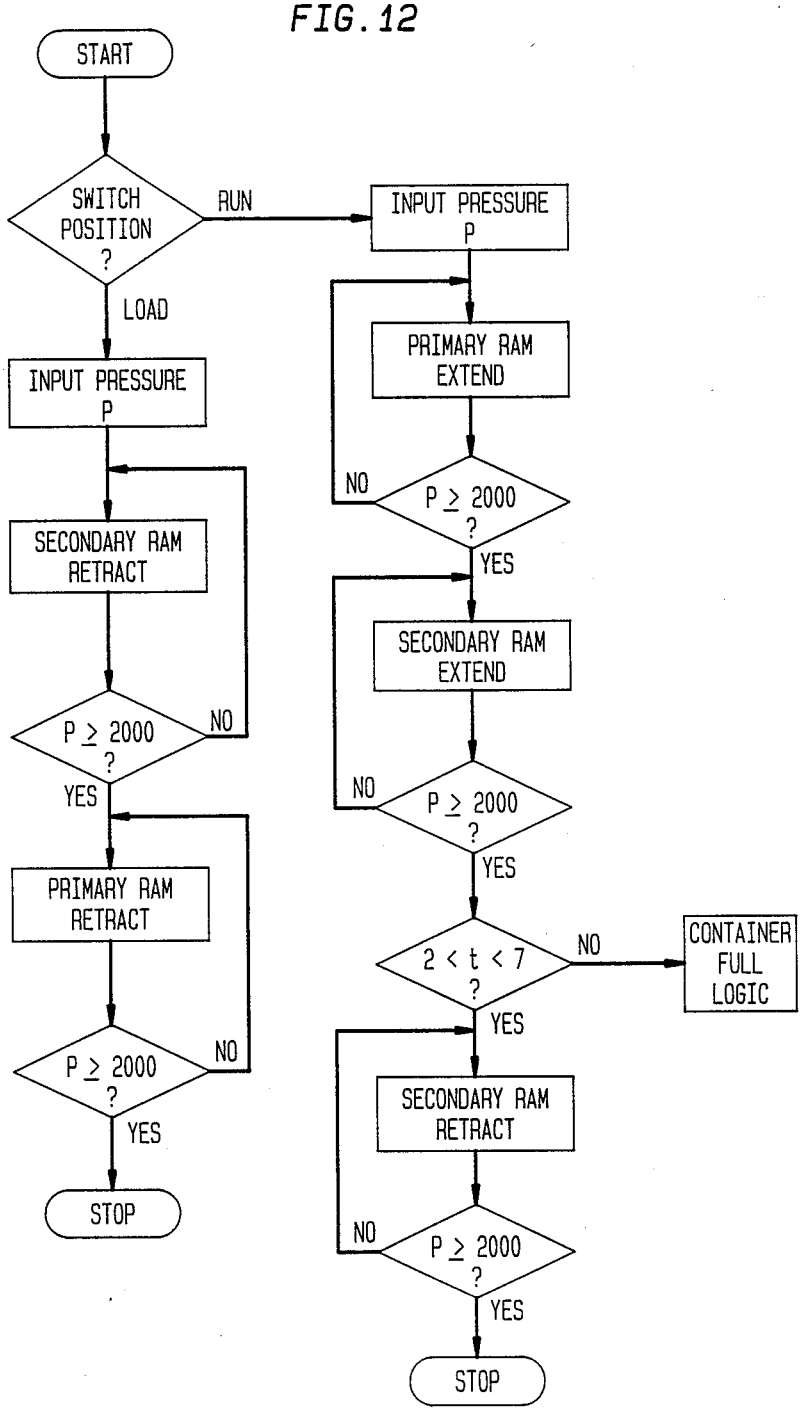
FIG. 12 is a flow chart showing the sequential steps of the controller system program.

The power system 24, and the position of the ram units 20, 22 connected thereto are controlled by the controller system 26. A control panel 168 preferably on one of the buttresses 82, comprises a key switch 170 and a start button 172. The key switch 170 permits at least two positions for load and run. The controller system 26 preferably comprises a computer program sequence as shown in FIG. 12, which may be programmed into a digital computer means (not shown). The digital computer means, at appropriate points in the sequence, receives signals from the pressure switch 164, and sends signals to solenoids (not shown) in the directional valves 166 in the fluid conduits 162. The program is initiated when an operator pulls the start button 172 on the control panel 168. If the microswitch 62, signalling the presence of a container 16 and the door safety switch 97, signalling the closure of the door are both engaged, power is enabled to be delivered to the controller 26. Upon initiation, the program determines which switch position the key 170 is in, either load or run. If the key switch 170 is in the load position, the program activates a solenoid causing the secondary ram unit 22 to retract. The program sequence then enters a loop continuously checking pressure readings from the pressure switch 164 against a preset limit value, preferably 2000 psi. When such limit is reached, the program deactivates the retraction of the secondary ram unit 22 and initiates retraction of the primary ram unit 20 by sending appropriate signals to the solenoids. The program sequence will again "loop", continuously checking the pressure value against the preset limit. When the limit is reached, the program stops further activity. If the key switch 170 is in the run position, the program first signals a solenoid to activate the extension of the primary ram unit 20, and enters a loop continuously checking the pressure until the preset pressure limit is reached. At the limit, the program switches signals to a solenoid controlling the extension of the secondary ram unit 22, and enters a second loop, continually measuring the pressure until the limit is reached. The time for the second loop to operate is measured by the computer means against an internal clock, and if the time value is between two seconds and seven seconds, a container full logic is initiated. The container full logic signals an indicator light 174 on the housing 12 (preferably on or near the control panel 68) indicating the container 16 is full, and signals a solenoid to initiate retraction of the secondary ram unit 22. If the container full logic is not initiated, and a signal is sent to retract the secondary ram unit 22, the program sequence enters a third loop, continually measuring the pressure, and when the pressure limit is reached, a stop signal is sent terminating movement of the ram assembly. When the secondary ram unit 22 is thus fully retracted, a signal is sent to a ram up indicator light 175 on the rear panel 72 indicating that the container 16 can, if necessary, be removed from the base 14 without being obstructed by the secondary ram unit 22.

Figure 6:
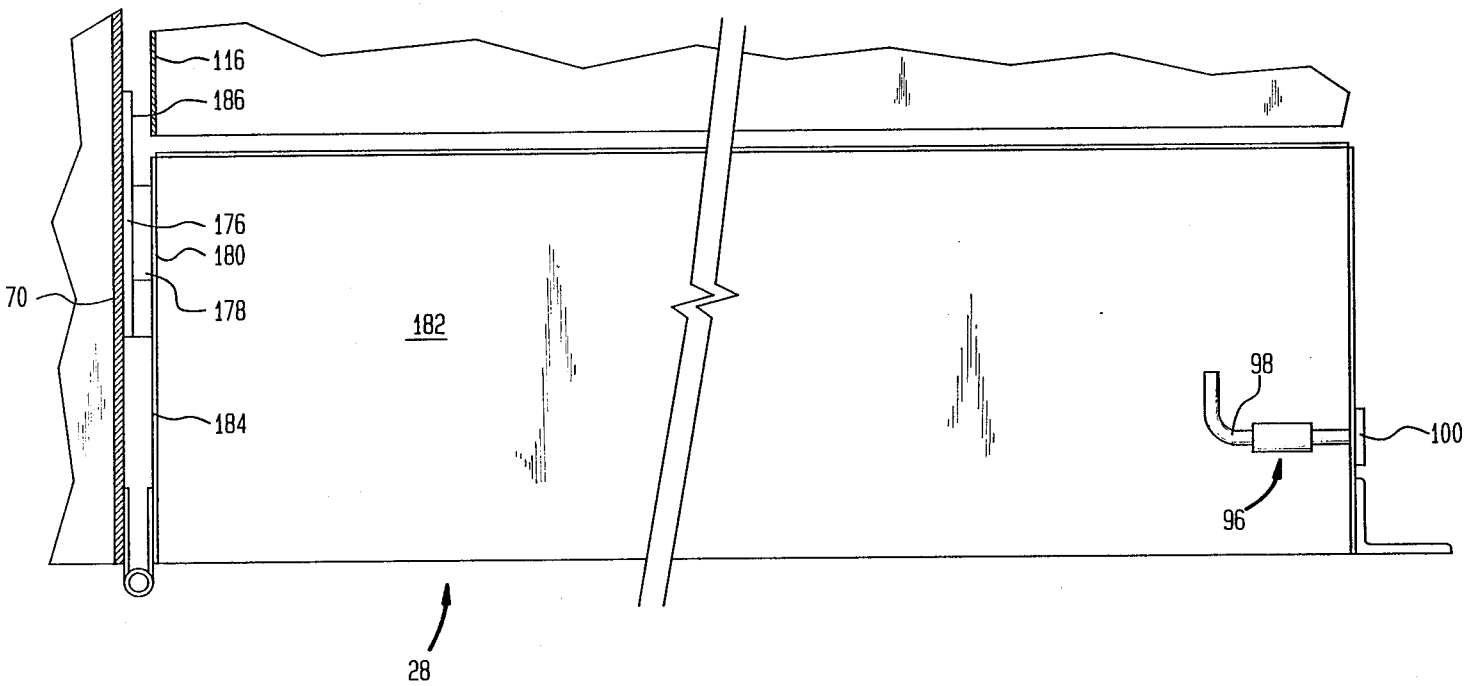
FIG. 6 is a sectional view of the loading door and door interlock taken generally along line 6—6 of FIG. 5.

As seen in FIGS. 5 and 6, the interlock means 30 comprises a lock plate 176 rigidly secured to the loading door 28 by means of a mounting bracket 178 as shown in FIG. 6. The mounting bracket 178 extends laterally outwardly from an upper end 180 of the arcuate portion 182 of the loading door 28. The lock plate 176 is rectangular in shape and mounts the mounting bracket 178 parallel to a side wall 184 of the loading door 28. The side wall 184 in turn is hingedly mounted to the left side panel 70 of the housing 12. It will be apparent that the door 28 can also be mounted in the reversed position so that it can be hinged to the right side panel 68. A lower portion 186 of the lock plate 176 extends inwardly of the arcuate portion 182 of the loading door 28. Thus, when the loading door 28 is closed, the lower portion 186 of the lock plate 176 is interposed between the left side panel 70 of the housing 12 and a side plate 116 of the primary ram unit 20. Thus, the loading door 28 cannot be opened when the primary ram unit 20 is in any but the retracted loading position, where the lower portion 186 of the lock plate 176 will be free of the side plate 116 of the primary ram unit 20.

Figure 8:
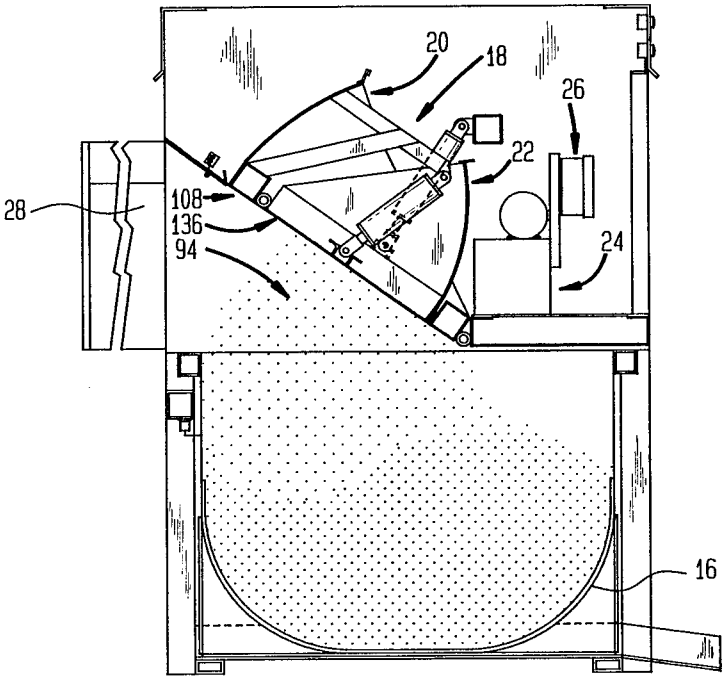
FIG. 8 is a side elevational view similar to FIG. 7, but showing the ram assembly in the retracted loading position.
Figure 10:
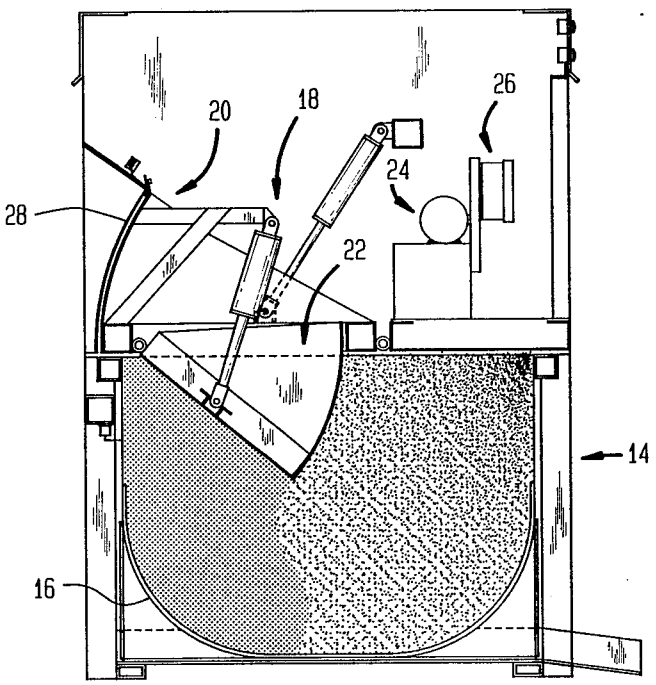
FIG. 10 is a side elevational view similar to FIGS. 7–9, but showing the ram assembly at the end of the secondary ram stroke.
Figure 9:
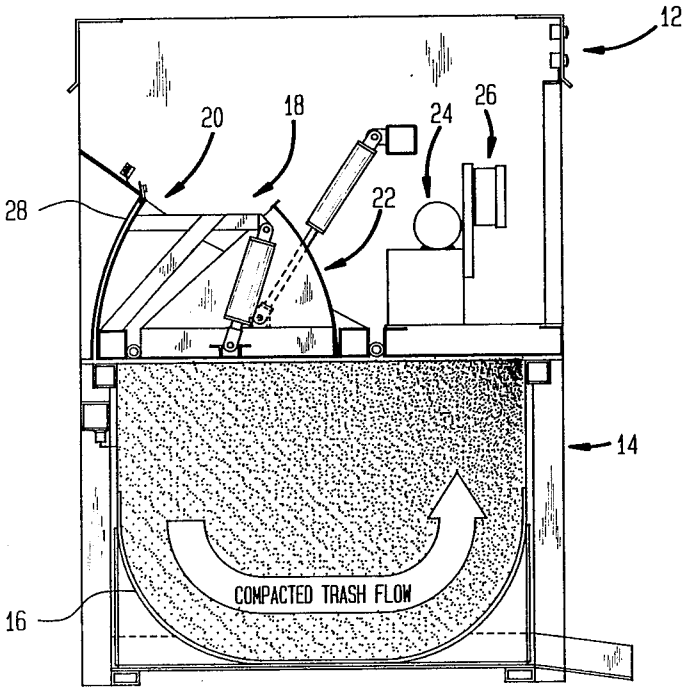
FIG. 9 is a side elevational view similar to FIGS. 7 and 8, but showing the ram assembly at the end of the primary ram stroke.
Figure 11:
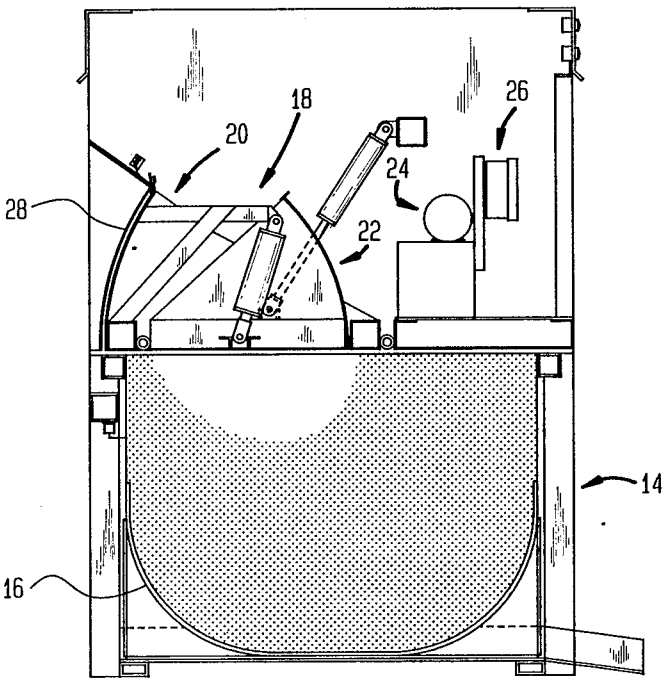
FIG. 11 is a side elevational view similar to FIGS. 7–10, but showing the ram assembly returned to the normal position.

In operation of the compactor 10, the container 16 is inserted into the base 14 on the container guides 52. The operator turns the key switch 170 to the load position and pulls the start button 172, which raises the primary ram unit 20 along with the secondary ram unit 22 carried thereby, to the load position as shown in FIG. 8. The locking plate 176 on the loading door 28 is thus free of the side plate 116 of the primary ram unit 20, and the operator can then open the loading door 28 to pass waste material into the container 16. The waste material is deflected from the primary platen 108 and secondary platen 136 carried therewith and into the container 16. The operator then closes and latches the loading door 28, turns the key switch 170 to the run position, and pulls the start button 172. The start button 172 initiates the automatic preprogrammed cycle of the controller system 26 which moves the primary ram unit 20 to the normal or primary packing position shown in FIG. 9, followed by moving the secondary ram unit 22 to the extended or secondary compacting position shown in FIG. 10. The cycle continues by retracting the secondary ram unit 22 to the normal position shown in FIG. 11, whereupon the controller system 26 automatically shuts itself off.

It will be apparent to those skilled in the art that other embodiments of the invention are possible. For example, the controller system may comprise a simple set of electro-mechanical relays. It is clear that reasonable variation and modification are possible within the spirit of the foregoing specification and drawings without departing from the scope of the invention which is defined by the accompanying claims.

The embodiments of the invention in which an exclusive property or privilege is claimed are defined as follows:

1. In a compactor for waste material comprising a base adapted to receive an open-top container, said open-top container being adapted to receive waste material therein, a housing mounted on said base, ram means mounted in said housing and adapted for compacting waste material in said open-top container, and power means operably connected to said ram means to move said ram means, the improvement in said ram means comprising:

a first platen pivotably connected to one of said base and said housing for swinging movement about a first axis between a retracted loading position and a normal position relative to said base, and a second platen pivotably connected to and carried by said first platen for swinging movement about a second axis between a retracted position relative to said first platen and generally parallel to said first platen and an extended position relative to said first platen.

2. A compactor according to claim 1 further comprising a pair of parallel container guides, each of which is secured to the base near to a lower end thereof and adapted to receive the container in sliding engagement therewith.

3. A compactor according to claim 1 wherein the base has four sides and the housing is removably mounted to the base, so that the housing can be selectively rotated about a vertical axis whereby one of the said first and second axes will be generally parallel to one of said sides when said base is selectively rotated.

4. A compactor according to claim 1 wherein the housing has top, side, front and rear panels, the front panel at least partially defining an opening for receiving waste material, the rear panel having a portion thereof removable for access to the interior of the housing, and the side panels have buttresses for strengthening the housing.

5. A compactor according to claim 4 and further comprising a door having first and second ends, said first end being hingedly mounted to a side panel, and said second end adapted to be secured to another side panel by a latch means.

6. A compactor according to claim 5 wherein said other side panel is formed with an aperture and said latch means comprises a movable rod mounted on the door proximate the second end thereof and adapted to be received in the aperture.

7. A compactor according to claim 6 wherein the aperture is elongated in a vertical direction.

8. A compactor according to claim 1 wherein said first platen moves in a first angular direction and said second platen moves in a second angular direction.

9. A compactor according to claim 8 wherein said first angular direction is opposite to said second angular direction.

10. A compactor according to claim 1 wherein said housing at least partially defines an opening for the entry of trash into said open-top container when said container is disposed in said base and said housing is mounted to said base.

11. A compactor according to claim 10 wherein one of said first and second platens has a free end for swinging about one of said first and second axes, and said one platen further includes a curved plate extending upwardly from the free end, generally conforming to the curvature of the arc defined by the movement of the free end to keep waste material from getting behind said platen.

12. A compactor according to claim 11 wherein a door covers said opening, said first platen has a curved plate, and said door has a portion thereof arcuate in shape complementary to said curved plate, said portion being adjacent to the curved plate when the first platen is away from the retracted loading position.

13. A compactor according to claim 12 wherein said door is mounted to said housing for swinging movement about a vertical axis, said first platen has a side wall extending between said platen and said curved plate, and including a lock plate rigidly secured to said door wherein the lock plate is adjacent to and parallel with the side walls when the first platen is away from the retracted position so that the side wall will interfere with the swinging movement of the door thereby restricting the door from being opened.

14. A compactor according to claim 11 wherein a resilient wiper blade is mounted on the housing in juxtaposition to the curved plate and extending transversely thereof for scraping said curved plate as the free end of the first platen is moved.

15. A compactor according to claim 14 wherein each of said first and second platens has a free end and a curved plate extending upwardly from said free end, and a resilient wiper blade is mounted on the first platen in juxtaposition to the second platen curved plate and extending transversely thereof for scraping said second platen curved plate as the free end of the second platen moves with respect to the first platen.

16. In a compactor for waste material comprising a base adapted to receive an open-top container, said open-top container being adapted to receive waste material therein, a housing mounted on said base, ram means mounted in said housing and adapted for compacting waste material in said open-top container, and power means operably connected to said ram means to move said ram means, the improvement in said ram means comprising: a first platen pivotably connected to one of said base and said housing for rotation about a first axis in a first angular direction between a retracted loading position and a normal position relative to said base, and a second platen pivotably connected to and carried by said first platen, and rotatable about a second axis in a second angular direction between a retracted position relative to and generally parallel to said first platen and an extended position relative to said first platen.

17. A compactor according to claim 16 comprising controller means operatively connected to said power means for controlling movement of said first and second platens, respectively.

18. In a compactor having a ram means enclosed within a housing for compacting waste material in an open-top container, said ram means having a side wall and further being adapted for movement to and from a retracted loading position, said housing having an opening therethrough and a door adjacent to the ram means to cover said opening, the improvement comprising said door being hingedly mounted to the housing for swinging movement about a vertical axis, a lock plate rigidly secured to said door in a position wherein the lock plate is adjacent to and parallel with the side wall when the ram means is away from the retracted position so that the side wall will interfere with the swinging movement of the door thereby restricting the door from being opened.

* * * * *

UNITED STATES PATENT AND TRADEMARK OFFICE

CERTIFICATE OF CORRECTION

PATENT NO. : 4,896,593

DATED : January 30, 1990

INVENTOR(S) : BOYD C. SLUSSER

It is certified that error appears in the above-identified patent and that said Letters Patent is hereby corrected as shown below:

Claim 13, column 9, line 38:
"walls" should be --wall--;

Claim 16, column 10, line 17:
after "comprising:" insert a new paragraph beginning "a first platen";

Claim 16, column 10, line 21:
after "base, and" insert a new paragraph beginning "a second platen";

Claim 18, column 10, line 37:
after "comprising" insert --:-- and insert a new paragraph beginning "said door".

Signed and Sealed this

Eighth Day of October, 1991

*Attest:*

HARRY F. MANBECK, JR.

*Attesting Officer*

*Commissioner of Patents and Trademarks*